US006432162B1

(12) United States Patent
Ruegg et al.

(10) Patent No.: US 6,432,162 B1
(45) Date of Patent: Aug. 13, 2002

(54) PROCESS FOR MELTING ASHES, SLAGS OR GLASS

(75) Inventors: Hans Ruegg, Wohlen; Christian Steiner, Zürich; Beat Stoffel, Zumikon; Christian Wieckert, Seon, all of (CH)

(73) Assignee: Asea Brown Boveri AG, Baden (CH)

( * ) Notice: Subject to any disclaimer, the term of this patent is extended or adjusted under 35 U.S.C. 154(b) by 0 days.

(21) Appl. No.: 09/375,369

(22) Filed: Aug. 17, 1999

(30) Foreign Application Priority Data

Aug. 24, 1998 (EP) ..... 98810835

(51) Int. Cl.[7] ..... C22B 7/04

(52) U.S. Cl. ..... 75/414; 65/19; 65/134.7; 432/13

(58) Field of Search ..... 75/414; 65/19, 65/134.7; 432/13

(56) References Cited

U.S. PATENT DOCUMENTS 3,934,864 A 1/1976 Morlet
4,272,286 A 6/1981 Schempp
4,519,814 A * 5/1985 Demarest, Jr. ..... 65/27
5,259,863 A * 11/1993 Schneider et al. ..... 75/414
5,843,204 A * 12/1998 Ishikawa et al. ..... 75/414
6,039,786 A * 3/2000 Marles Franco ..... 75/414

FOREIGN PATENT DOCUMENTS

| | | |
|---|---|---|
| AU | 543552 | 4/1985 |
| CH | 1298256 | 3/1987 |
| WO | WO8703913 | 7/1987 |

* cited by examiner

*Primary Examiner*—Melvyn Andrews
(74) *Attorney, Agent, or Firm*—Burns, Doane, Swecker & Mathis, L.L.P.

(57) ABSTRACT

In a process for melting inorganic materials (7) in a rotary horizontal converter or a rotary kiln (1) by adding fuel (8), oxygen or oxygen-enriched gases (10) and the inorganic materials (7) to a liquid bath (5), solid fuel (8) is added in piece form. The oxygen or the oxygen-enriched gas (10) is blown at high velocity (v) onto the surface of the bath (5), reacts with the solid fuel (8) and releases heat in the course of this. By means of the process of the invention, high temperatures can be achieved with the use of inexpensive fuels.

8 Claims, 2 Drawing Sheets

PROCESS FOR MELTING ASHES, SLAGS OR GLASS

FIELD OF THE INVENTION

The invention relates to a process for melting inorganic materials, in particular ashes, slags, glass and metals in a rotary horizontal converter or a rotary kiln.

BACKGROUND OF THE INVENTION

In metallurgy, various processes are known for melting solid materials. The energy which is required for melting the solids is provided here either via a fossil-fueled heater or an electrical heater.

Fossil-fueled heaters generally use burners which are charged with liquid, gaseous or pulverized fuels. To oxidize the fuel, in addition to air, oxygen and oxygen-enriched air are also used. The latter is advantageous if materials having a high melting temperature, for example metallurgical slags, are to be melted. The flame temperature which can be achieved is considerably higher in this case than when air is used. In addition, the amount of exhaust gas is less, which leads to lower losses of exhaust gas and to fuel savings.

The disadvantage of the fossil-fueled burner heaters is that the heat generated can only be transmitted via the surface of the material to be melted. The heat-transfer surface is limited by this. If the melting process is carried out in non-agitated converters, in addition, the heat conduction in the bath and the internal bath convection are small.

These findings have led to the development of what are termed underbath burners. In these, a cooled burner lance is immersed directly in the bath, and the fuels are injected into the bath together with an oxidizing agent. A disadvantage in this case is the complex cooling, which is not without hazard, of these burners and the limited depth of penetration which can be achieved. Only gaseous and liquid fuels can be used.

In contrast, in the case of the electric melting processes (resistance, induction, arc and plasma heaters), high temperatures can advantageously be reached, and the exhaust gas losses are eliminated. However, a disadvantage is the high energy and plant costs.

SUMMARY OF THE INVENTION

Accordingly, one object of the invention is to provide a novel process for melting inorganic materials, which avoids these disadvantages, permits the use of inexpensive fuels and by which, nevertheless, the required high temperatures are achieved.

According to the invention, this is achieved by a process for melting inorganic materials in a rotary horizontal converter or a rotary kiln by adding fuel, oxygen or oxygen-enriched gases and the inorganic materials to a liquid bath. The solid fuel is added in piece form and the oxygen or the oxygen-enriched gas is blown at high velocity onto the bath surface, said gas reacting with the solid fuel and releasing heat during the process.

The advantages of the invention are that, for melting the inorganic materials, inexpensive fuels can be used.

In addition, owing to the oxygen impingement of the bath at high velocity, an intensive stirring action is generated at the bath surface. The use of a rotary converter or a rotary tubular kiln ensures that the material to be heated is continuously agitated and mixed. Unmolten material floats in this case, as a result of lower density, preferably at the surface and there comes intensively into contact with the hot oxidizing fuels and combustion gases.

It is particularly expedient if the velocity at which the oxygen or the oxygen-enriched gas is blown onto the bath surface is at least as high as the velocity of sound. Then, intensive stirring action and, resulting therefrom, good mixing of the reacting materials is ensured.

It is advantageous if the fuel used is coal or carboniferous fuel and the coal or the carboniferous fuel and the oxygen are fed continuously, since by this means the redox state in the gas phase and also the redox state in the bath can be set as desired via the ratio of coal to oxygen. In particular, reducing conditions can be set with stoichiometric ratios of carbon to oxygen of greater than 1 in order to reduce heavy metals in the bath to their metallic form and evaporate them off.

It is further expedient if the fuel used is dry or predried wastes. This is a particularly cheap variant.

It is advantageous if the furnace is operated in such a manner that, during startup, a bath of molten material is charged, which molten material is either generated by using conventional burners which are operated using liquid, gaseous or pulverized fuels, or is introduced by charging from a further melting furnace. Not until thereafter are piece-type fuel and the material to be melted fed to the converter and impinged with oxygen, the oxygen reacting with the solid fuel and heat being released which leads to melting of the material used. Owing to the fact that during startup of the furnace a liquid bath of molten material is already present, firstly the piece-type fuel, from the start, is situated at the surface of the melt and, secondly, no further precautions with regard to ignition of the piece-type fuel subsequently used need to be taken.

If metals are to be melted by the process of the invention, it is advantageous if the converter is charged with two phases, a metal phase and a slag phase thereabove, the injected oxygen being brought to reaction with the fuel on or in the slag phase. This prevents the injected oxygen coming into contact directly with the molten or still unmolten metal. The oxygen only reacts with the fuel on the slag phase. This releases the heat which is necessary for melting the still solid metal.

Furthermore, it is advantageous if grate ash from refuse incineration is fused by direct combustion of dry, predried, pyrolyzed or gasified wastes or residues, where, together with the grate ash, boiler ash and/or filter ash from refuse incineration can also be fused.

BRIEF DESCRIPTION OF THE DRAWINGS

Preferred embodiments of the invention are disclosed in the following description and illustrated in the accompanying drawings in which.

Only the elements which are essential for understanding the invention are shown.

DETAILED DESCRIPTION OF THE INVENTION

Figure 1:
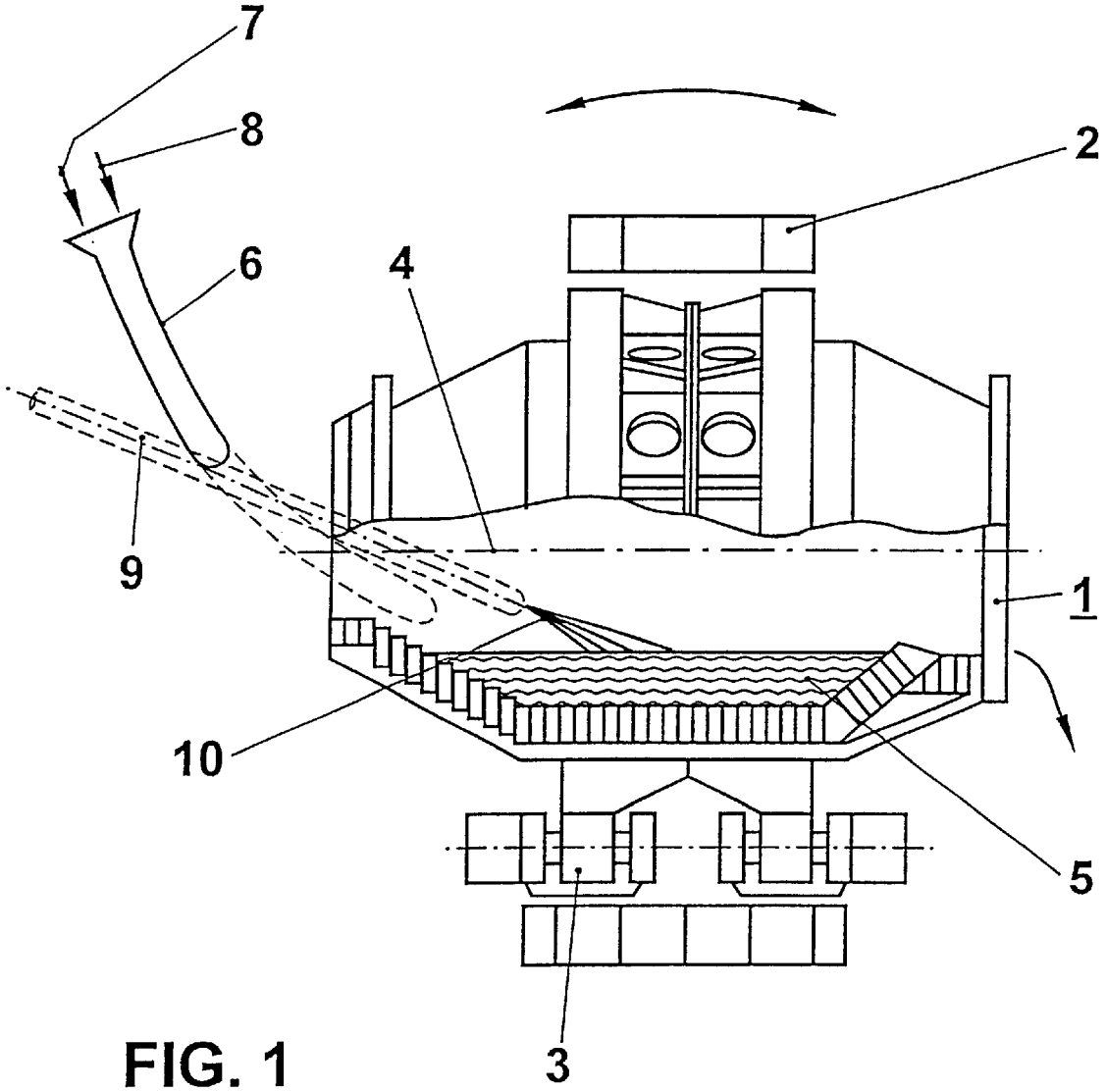
FIG. 1 shows a diagrammatic representation of a rotary horizontal converter for melting grate ash from refuse incineration.

Referring now to the drawings, wherein like reference numerals designate identical or corresponding parts throughout the several views, in FIG. 1, in simplified representation, a converter 1 is shown which, in a support frame 2, is disposed on motor-driven support rolls 3. The converter 1 has the form of a horizontal cylindrical drum and is open at both its ends, the internal diameter at the two ends being constricted so that the filling level is approximately 20% of the internal volume. By means of the support rolls 3, the converter 1 can be rotated about its axis 4. As indicated by the arrows in the upper part of FIG. 1, the converter 1 can be tilted for the purpose of emptying. In the interior of the converter is situated the molten bath 5 of the inorganic materials. The converter 1 is charged via a charging slide 6 with the predominantly inorganic materials to be melted 7, in the present embodiment grate ash from refuse incineration, and with the fuel 8. Via a water-cooled oxygen lance 9, oxygen or oxygen-enriched gas 10 is injected onto the surface of the bath 5 at a defined angle. Charging is performed from the one furnace side, drainage is performed via the opening on the opposite converter side.

The converter 1 is advantageously operated so that during startup a bath 5 of molten material is first generated. This is achieved firstly according to the known prior art by using conventional burners which, for example, are operated using gaseous fuel, for example natural gas, or using liquid fuel, for example oil. Another possibility is direct charging of the converter 1 with molten material from another melting furnace. Thereafter, piece-type fuel, preferably coal, carboniferous fuel or dry or predried wastes, and the material of inorganic materials to be melted 7 are added via the charging slide 6. Via the oxygen lance 9, oxygen or oxygen-enriched gas 10 is injected at a velocity so high that the oxygen 10 partially penetrates into the bath 5, reacts with the solid fuel 8 and releases heat which leads to the melting of the material 7 used. The stoichiometric ratio of carbon C to oxygen $O_2$ can be set as desired. With ratios greater than 1, reducing conditions are set, so that the heavy metals in the bath are reduced to their metallic form and evaporated off.

To achieve an intensive stirring action and mixing at the bath surface, the velocity v at which the oxygen impinges the bath 5 must be at least as high as the velocity of sound $v_s$. The use of a rotary converter ensures that the material to be heated is constantly agitated and mixed. Unmolten material floats in this case, as a result of lower density, at the surface and there comes intensively into contact with the hot oxidizing coal or the carboniferous fuel and the combustion gases.

The converter 1 can be charged either continuously or batchwise. Preferably, the inorganic materials to be melted 7, the fuel 8 and the oxygen 10 are fed continuously to the converter 1, so that the redox state in the gas phase can be set as desired by the choice of the fuel and oxygen rates, and also the redox state in the bath can be influenced. Thus, for example, using a substoichiometric oxygen feed, a reductive atmosphere in the gas space above the bath 5 and also in the bath 5 can be set and thus heavy metals can be caused to be reduced to their metallic form or from oxides to chlorides and evaporated off.

The residence times of the materials to be fused in the bath 5 are dependent on the bath temperature and the particle size of the feed material. For refuse incineration slag, the residence time at a bath temperature of approximately 1500° C. and with continuous charging is about 15 seconds. The residence time of the liquid phase is dependent on the furnace geometry and on the bath surface necessary for melting and is roughly in the region of hours. The bath temperature which is necessary to generate a mobile melt is, for example in the case of grate ash from refuse incineration (melting temperature approximately 1250° C.), greater than 1400° C.

Figure 2:
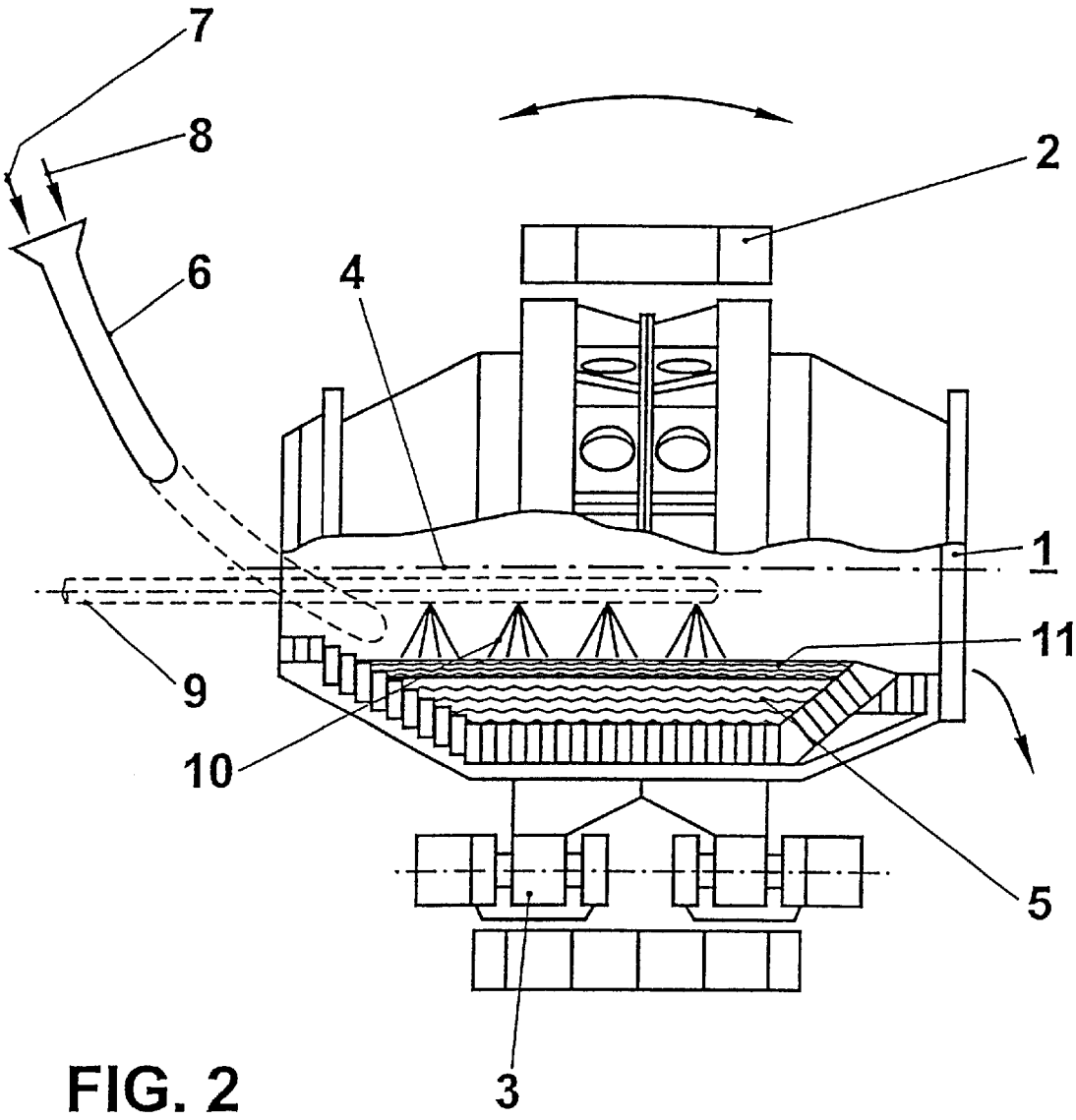
FIG. 2 shows a diagrammatic representation of a rotary horizontal converter for melting metal.

FIG. 2 shows a further embodiment of the invention. The plant shown differs from that shown in FIG. 1 by a different water-cooled oxygen lance 10 being used and, in the furnace, in addition to the slag phase, there being a further metal phase.

The oxygen lance 10 is oriented in parallel to the axis 4 of the converter 1. Along its longitudinal extension it has a plurality of nozzles directed onto the bath 5, through which the oxygen or the oxygen-enriched gas 10 is injected at a velocity v, which is equal to or higher than the velocity of sound $v_s$.

In this second embodiment, no slag is to be melted, but the inorganic materials to be melted 7 are in this case metals. If metals are to be melted, in addition to the metal phase 5, a second phase 11 of slag must be present in the converter 1. The lighter slag phase 11 floats on the heavier metal phase 5. The combustion reaction proceeds on the slag phase 11. This prevents the molten or unmolten metal from coming into contact directly with the injected oxygen 10. The metal is drained by tipping the converter with simultaneous retention of the liquid slag phase 11. This is made possible, for example, if the converter drainage side is provided with only a small opening, so that by rapid tipping of the converter 1, only the heavy metal phase 5 runs out through the opening and the lighter slag phase 11 remains in the converter 1. Charging is then performed continuously, and drainage batchwise.

Obviously, the invention is not restricted to the embodiments shown. Thus, instead of the rotary horizontal converter, a rotary tubular kiln can be used or, for example, the oxygen feed or the solids feed can be made in a different construction. The process is also applicable, for example, to fusing grate ash from refuse incineration by direct combustion of dry, predried, pyrolyzed or gasified waste or residues, in which case, together with the grate ash, boiler ash and/or filter ash from refuse incineration can also be fused.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A process for melting ashes, slags or glass in a rotary horizontal converter or a rotary kiln by adding fuel, oxygen or oxygen-enriched gases and the ashes, slags or glass to a liquid bath which comprises adding solid fuel in piece form to the liquid bath that is already present in the rotary horizontal converter or rotary kiln and blowing the oxygen or the oxygen-enriched gas at high velocity onto the surface of the bath, said gas reacting with the solid fuel and releasing heat in the course of the reaction.

2. The process as claimed in claim 1, wherein the velocity at which the oxygen or the oxygen-enriched gas is blown onto the surface of the bath is at least as high as the velocity of sound.

3. The process as claimed in claim 1, wherein the fuel used is coal or carboniferous fuel.

4. The process as claimed in claim 1, wherein the fuel used is dry or predried wastes.

5. The process as claimed in claim 3, wherein the stoichiometric ratio of carbon to oxygen is greater than 1.

6. The process as claimed in claim 1, wherein grate ash from refuse incineration is fused by direct combustion of dry, predried, pyrolyzed or gasified wastes or residues.

7. The process as claimed in claim 6, wherein, together with the grate ash, boiler ash and/or filter ash from refuse incineration is also fused.

8. The process as claimed in claim 1, wherein, the liquid bath is a bath of molten material that is already present in the rotary horizontal converter or rotary kiln during that, said molten material being capable of generation by conventional burners or a further melting furnace.

* * * * *